United States Patent [19]

Emmer

[11] Patent Number: 4,854,098

[45] Date of Patent: Aug. 8, 1989

[54] FACADE STRUCTURE

[75] Inventor: Hans Emmer, Liestal, Switzerland

[73] Assignee: Eltreva AG, Aesch, Switzerland

[21] Appl. No.: 97,140

[22] Filed: Sep. 16, 1987

[30] Foreign Application Priority Data

Sep. 17, 1986 [DE] Fed. Rep. of Germany ..... 3631566

[51] Int. Cl.[4] ..... E04B 1/60

[52] U.S. Cl. ..... 52/398; 52/400; 52/768; 52/769

[58] Field of Search ..... 52/487, 766, 767, 768, 52/769, 773, 774, 398, 400

[56] References Cited

U.S. PATENT DOCUMENTS

| | | | |
|---|---|---|---|
| 2,107,323 | 2/1938 | Bosshard | 52/767 |
| 2,205,538 | 6/1940 | Owen | 52/773 |
| 2,296,720 | 9/1942 | Lowry | 52/769 |
| 2,388,786 | 11/1945 | Knight | 52/769 |
| 2,736,404 | 2/1956 | Clingman | 52/400 |
| 3,118,188 | 1/1964 | Dulebohn | 52/768 |
| 3,222,839 | 12/1965 | Philpat | 52/768 |
| 3,242,627 | 3/1966 | Fountain | 52/769 |
| 4,335,552 | 6/1982 | Blanchett | 52/400 |

FOREIGN PATENT DOCUMENTS

| | | | |
|---|---|---|---|
| 2060773 | 6/1972 | Fed. Rep. of Germany | 52/769 |
| 2241251 | 3/1973 | Fed. Rep. of Germany | 52/400 |
| 926881 | 10/1947 | France | 52/773 |
| 1232344 | 5/1971 | United Kingdom | 52/400 |

*Primary Examiner*—Henry B. Raduazo

*Attorney, Agent, or Firm*—Foley & Lardner, Schwartz, Jeffery, Schwaab, Mack, Blumenthal & Evans

[57] ABSTRACT

The invention relates to a facade structure having an inner bearer for at least one plate element. Holders engage behind the plate element in its edge region, and they are mounted in the bearer so as to be adjustable relative thereto. To ensure constant centering of the plate element according to the invention, the holder is pivotable within a plane lying horizontally and perpendicularly to the vertical plate element and is pressed into its engagement position by a resilient member in such a way that a retaining projection thereof engages behind the edge of the plate element at a constantly equal depth.

14 Claims, 3 Drawing Sheets

FACADE STRUCTURE

BACKGROUND OF THE INVENTION

The present invention relates to a facade structure having an inner bearer for at least one plate element. Holders engage behind the plate element in its edge region, and they are mounted in the bearer so as to be adjustable relative thereto.

One embodiment of this general type is disclosed in German Offenlegungsschrift No. 3,439,436. Here, the bearer is shown as a post or transom comprising an aluminum section. The plate element is an insulating glass unit, having in its edge region inserted U-shaped outwardly open sectional rails forming a continuous frame or alternatively being inserted only in spaced locations. The insulating glass unit is supported on the post section via a glass contact gasket. Fixed to the post section are holders that form a row and are equipped, at their free ends, with flanges which engage into the U-shaped sectional rails. These flanges are set back from the outer faces of the insulating glass panes; the space formed thereby is filled with a sealing compound, so as to form a smooth outer surface for the facade. Each holder is equipped with a hammerhead-shaped turned fastening part which can be introduced into a T-shaped slot provided on the outer face of the post section and which can be secured by means of a quarter turn. The opposite end of the holder has the flange which at the same time engages into sectional rails of two insulating glass units located next to one another.

The holder is rotatable about its longitudinal center axis relative to the post section. The depth of engagement of the flange into the U-shaped sectional rail of the insulating glass unit depends on its position in relation to the holder. However, on the one hand, this position cannot be foreseen exactly when the facade structure is produced, and, on the other hand, it can vary during the "operation" of the facade structure. Because of the customary tolerances for glass blanks which are of the order of ±2 mm, the pane edge, behind which the holder engages, can be nearer the holder or farther away from it. Corresponding differences also arise under the effect of temperatures caused by the weather, which result in different longitudinal expansions of the glass and the metal sections. Under the effect of wind loads pronounced deflection of the insulating glass unit and consequently a reduction in its length or width can occur. A further disadvantage of the structure described above is that the holders each exert a point load on the edge of the inwardly facing insulating pane, behind which they engage. The blank tolerances, which can amount to as much as 3 mm where triple insulating glass is concerned, plus the longitudinal expansion of the aluminum frame, plus the effect of wind load, have to be taken into account in the structure from the outset, and this disadvantageously leads to large batch widths.

SUMMARY OF THE INVENTION

It is therefore an object of the invention to provide an improved facade structure of the type mentioned in the introduction.

It is a particular object of the invention to provide such a facade structure having improved means for mounting of the plate elements.

In accomplishing the foregoing objects, there has been provided according to the present invention a facade structure, comprising an inner bearing member which defines a portion of the periphery of an opening; a plate element designed to cover the opening; a holder which engages by means of a retaining projection behind an edge region of the plate element; means for pivotally mounting the holder onto the inner bearing member such that the holder is pivotable about an axis which extends parallel to the edge region of the plate elements; and means for resiliently pivoting the holder about the axis and for pressing the holder into engagement with the plate element so that the retaining projection engages behind the edge region at a constant depth.

Further objects, features, and advantages of the invention are explained in the detailed description of preferred embodiments which follows, when considered together with the attached drawings.

BRIEF DESCRIPTION OF THE DRAWINGS

The drawings illustrate exemplary preferred embodiments of the invention. In the drawings.

DETAILED DESCRIPTION OF THE PREFERRED EMBODIMENTS

The design according to the invention makes it possible to obtain a constant centered mounting of the plate element, while each time maintaining the same depth of engagement-behind of the retaining projection. Even relatively large blank tolerances, different longitudinal expansions of the plate element and bearer and bending of the plate elements are compensated, while the centering of the latter is preserved.

In the solution according to the invention, the holder can be made strip-shaped, thus avoiding point loads on the edge of the plate element where engagement takes place. The holder is preferable made of plastic, for example, polyamide, so that there is insulation between the plate element and the bearer.

The bearer can have any construction per se and can be made, for example, of wood or metal. It can be a window or door sash, a post or transom or another aluminum or plastic sectional structure. The plate element can be an insulating glass unit, a filler element or a different panel.

The resilient member can be an expanding or helical spring, an elastomeric body or the like. The resilient member can also be made integral with the holder. In a preferred embodiment, the resilient member is a spring strip which is bent so as to be approximately V-shaped in cross-section and which is supported by means of one leg on the bearer and rests by means of its other leg under prestress against the side of the holder located opposite the engaged plate edge. For visual reasons, the slot formed by the spring strip can be covered by an elastic cover section.

The holder can also perform further functions, for example, as edge protection for the outer pane or as the carrier of a gasket.

Only local supporting faces need be provided for wedging purposes. According to the invention, local strip-shaped supporting faces can be pushed into a sectional slot, into which the spring strip is also snapped. The supporting faces can also be snapped in. These wedging bridges can be provided, for example, only in the corner region of the plate element, so that the spring strip and the holder can each extend between two wedging bridges over most of the edge length of the plate element.

Figure 1:
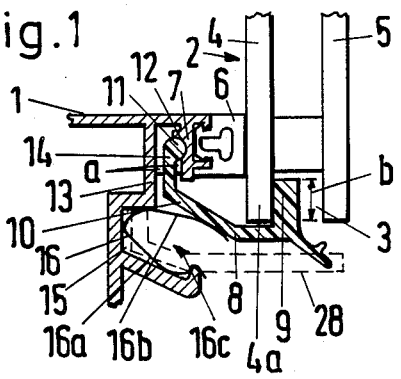
FIG. 1 is a partial cross-section showing a portion of a facade structure.

FIG. 1 shows, in cut-out form, a facade structure with an inner bearer in the form of a metal section 1, to which at least one plate element 2 in the form of an insulating glass unit is fastened. The latter has, in its edge region, a continuous outwardly open slot 3 between the pane 4 facing the inside and the outer pane 5. In this special insulating pane the edge bond is offset inwardly. The insulating glass unit is supported, by means of its pane 4 facing the inside, on one leg 7 of the metal section 1 via a glass contact gasket 6. A holder 8 engages into the slot 3 and is mounted on the metal section 1 so as to be pivotable within a plane lying horizontally and perpendicularly to the vertical plate element 2, i.e., about an axis which runs parallel to the edge of the plate element 2.

The holder 8 is made of plastic, forms a strip extending over most of the edge length of the plate element 2 and, in cross-section, is designed approximately as a U-shaped bow, one U-leg of which forms a retaining projection 9 engaging into the slot 3, while its other U-leg 10 lying approximately parallel to this merges, at its free end, into a beaded edge 11. The latter has an approximately round cross-section and engages into an approximately semicircular groove 12 which matches its outer contour and which is located in the leg 7 that carries the glass contact gasket 6 on its opposite side. Since the U-leg 10 is at a clear distance "a" from each of the adjacent legs 7, 13, it is possible for the holder 8 to pivot to a limited extent about the center point 14 of its beaded edge 11.

Snapped into a sectional slot 15 in the metal section 1 is a resilient member 16 in the form of a spring strip which is bent so as to be approximately V-shaped in cross-section and which is supported by means of one leg **16*a* on the metal section 1 and rests by means of its other leg 16*b* under prestress against the side of the holder 8 located opposite the pane 4. FIG. 1 shows that the holder 8 is pressed into its engagement position by the resilient member 16 in such a way that, by means of its retaining projection 9, it engages behind the inner edge 4*a* of the plate element 2 at a constantly equal depth b. This depth of engagement b is maintained even when the plate element 2 is oversized or undersized or moves somewhat out of its centering position as a result of wind loads. Thus, the design and arrangement of the holder 8, in conjunction with the resilient member 16 subjecting it to stress, result in a self-adjusting mounting of the plate element 2**.

Figure 2:
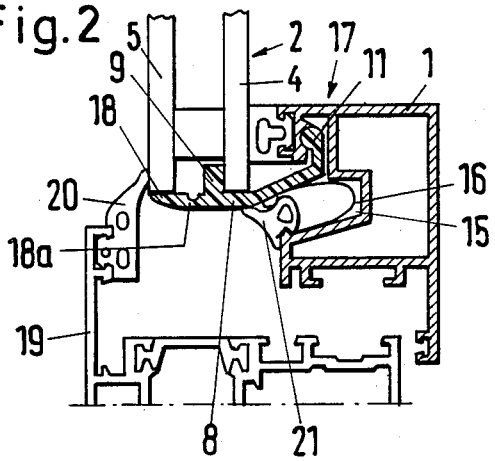
FIG. 2 is a cross-section showing a portion of a casement and window frame in a representation according to FIG. 1.

In the embodiment according to FIG. 2, the metal section 1 forms a window sash 17. The holder 8 has a weather-side extension 18 which extends under the edge of the outer pane 5 and which thus provides edge protection for it. The weather-side face of the outer pane 5 is therefore completely free even in its edge region and, when the window sash 17 is in the closed position, rests against a stop seal 20 fitted in the blind frame or window frame 19. For visual reasons, the slot **16*c* formed by the spring strip is covered, here, by an elastic cover section 21. To ensure that the retaining projection 9 penetrates completely, a predetermined bending point 18*a* can be provided in the weather-side extension 18**.

Figure 3:
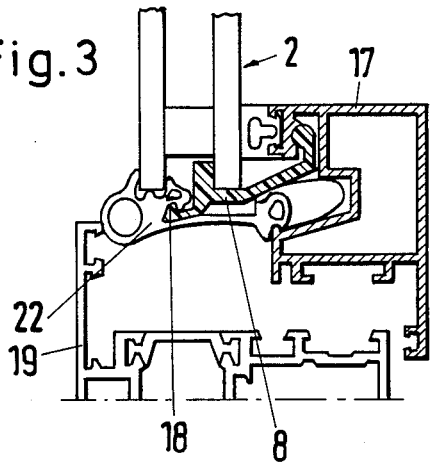
FIG. 3 shows the embodiment illustrated in FIG. 2 with modified stop seal.

In the modified embodiment according to FIG. 3 the weather-side extension 18 of the holder 8 carries an elastic edge protection 22 which surrounds the edge of the outer pane 5 and which, at the same time, forms a stop seal relative to the window frame 19. According to this exemplary embodiment, the cover section 21 and the elastic edge protection 22 can be made in one piece.

Figure 4:
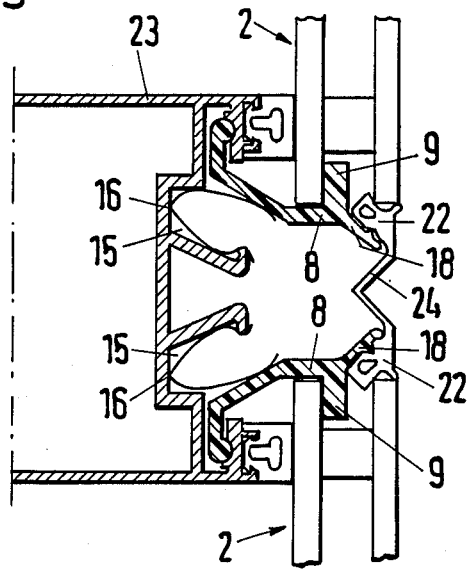
FIG. 4 shows a design according to FIG. 1 for a post/transom structure.

In the embodiment according to FIG. 4, the bearer for the plate element 2 is formed by a post 23 or a transom. Here, the elastic edge protection 22 carried by the weather-side extension 18 of the holder 8 forms, at the same time, a closure 24 for the interspace between two adjacent outer panes 5. It can be seen, in this embodiment in particular, that, instead of the two V-shaped spring strips 16, there can also be provided a compression spring, an elastomeric supporting part or the like, which subjects the two holders 8 to stress simultaneously. It can be seen, furthermore, that the elastic edge protection 22, in conjunction with the closure 24, could also be a sealing means which closes the interspace between two adjacent outer panes 5 flush with the surface of the latter.

Figure 5:
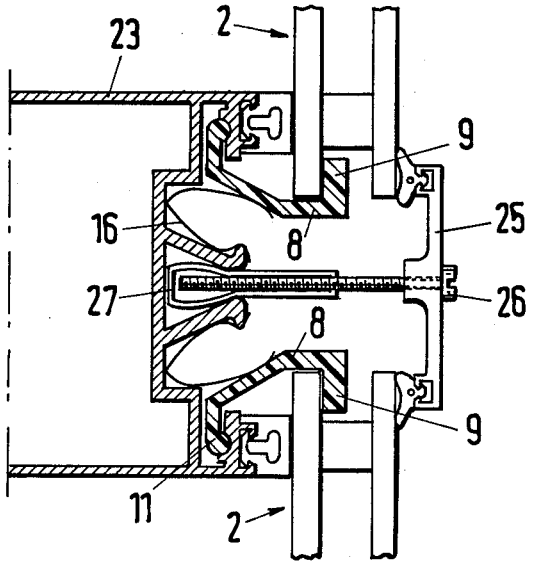
FIG. 5 shows the embodiment illustrated in FIG. 4 with a modified pane cover.

In the embodiment according to FIG. 5, the elastic edge protection 22 and the closure 24 according to FIG. 4 are replaced by an outer cover strip 25 screwed to the post section by means of a screw 26 which engages into an expanding dowel 27 made of plastic.

If the insulating glass unit is arranged vertically, a wedging means absorbing the dead weight of this insulating glass unit may be necessary, particularly underneath the latter. For this purpose, there are provided strip-shaped supporting faces 28 which are snapped locally into the sectional slot 15 in the metal section 1, as can be seen represented by broken lines in FIG. 1. These wedging bridges can be arranged preferably at the horizontal and/or vertical edge ends of the insulating glass unit; the spring strips 16 and the holders 8 then extend between the respective wedging bridges.

The facade structure according to the invention can absorb directly all conventional glass-blank tolerances and nevertheless keep the insulating glass unit constantly centered. It is also possible to exchange the glass without difficulty. The holder engages behind the pane of the insulating glass unit which faces inwardly at a constantly equal depth, even under pronounced deflection of this pane, and even in the event of different longitudinal expansions of the glass and frame. Point loads on the pane facing the frame are avoided by means of the holders being arranged continuously.

FIGS. 1 to 5 show that the holder 8 rests against the outer edge of the pane 4, by means of a planar stop face.

Figure 6:
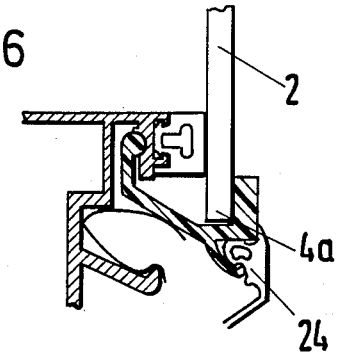
FIG. 6 shows an embodiment according to FIG. 1 for single glazing.
Figure 7:
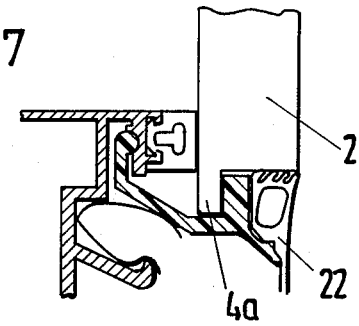
FIG. 7 shows the embodiment according to FIG. 6 for a panel.

Whereas, in each of the embodiments according to FIGS. 1 to 5, the plate element 2 is designed in the form of double insulating glazing, FIG. 6 shows single glazing and FIG. 7 a panel. However, these structures otherwise correspond the that of FIG. 1.

Figure 8:
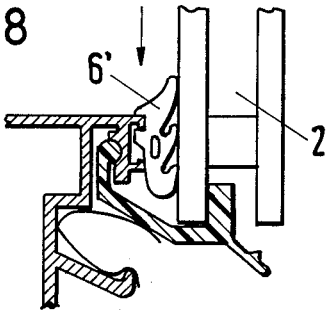
FIG. 8 shows an embodiment according to FIG. 1 with a modified glass contact gasket.

The glass contact gasket 6 illustrated in FIG. 1 is suitable for horizontal glass installation, in which the necessary pressure on the gasket is obtained in a simple way (as a result of the dead weight of the glass and, if appropriate, additional applied pressure). However, in the post/transom solution illustrated in FIG. 4, glazing is usually carried out only on site and therefore vertically. In this case, the holders 8 would first be introduced, together with the resilient member 16, with the gasket facing the room being inserted only at the final stage. FIG. 8 shows a design of a glass contact gasket 6' particularly suitable for this.

Figure 9:
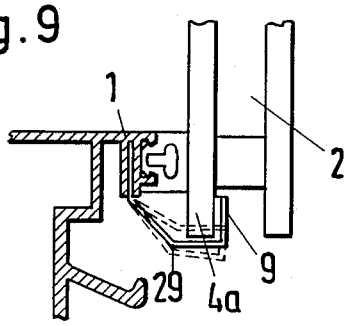
FIG. 9 shows a modified embodiment in a representation according to FIG. 8.

FIG. 9 illustrates an embodiment in which the holder and resilient member are made in one piece and comprise a holder 29 which is clamped in the metal section and which can be pivoted, as represented by broken lines, and is pressed permanently into its engagement position as a result of its inherent spring tension.

What is claimed is:

1. A facade structure, comprising:

an inner bearing member which defines a portion of the periphery of an opening;

a plate element constituting a front surface, a back surface and a lateral edge, said back surface covering said opening;

means for automatically centering said plate element, said means being a holder which engages an edge region of said plate element by means of a retaining projection;

means for pivotally mounting said holder onto said inner bearing member such that the holder is pivotable about an axis which extends parallel to said edge region of said plate element;

means for resiliently pivoting said holder about said axis and for pressing the holder within the plane of said plate element against the lateral edge of the plate element so that said retaining projection engages behind said edge region at a constant depth;

the holder comprises a plastic strip-shaped form extending along a substantial portion of the edge region on said plate element; and said pivotal mounting means comprises a beaded edge on said holder and a groove which matches the outer contour of the beaded edge located in the bearing member.

2. A facade structure as claimed in claim 1, wherein said beaded edge and said groove have an essentially round cross-section.

3. A facade structure as claimed in claim 1, wherein the holder has an approximately U-shaped cross-section, one U-leg of which forms the retaining projection, while its other U-leg lies approximately parallel and carries said beaded edge at its free end.

4. A facade structure as claimed in claim 3, wherein the resilient pivoting and pressing means comprises a spring strip having an approximately V-shaped cross-section and being fitted into a slot, one leg of said spring strip being supported by means of the bearing member and its other leg pressing against the holder on its side located opposite the plate edge.

5. A facade structure as claimed in claim 4, further comprising an elastic cover section covering the slot occupied by the spring strip.

6. A facade structure as claimed in claim 1, wherein the holder and the resilient pivoting means comprise a single piece.

7. A facade structure as claimed in claim 1, wherein the bearing member comprises a metal section for mounting at least one insulating glass unit, and said plate element comprises a glass unit having in its edge region a continuous outwardly open space between an inner pane and an outer pane, said structure further comprising a glass contact gasket for supporting the glass unit on said metal section.

8. A facade structure as claimed in claim 7, wherein the holder includes a weather-side extension cooperating to form an edge protection for the outer pane.

9. A facade structure as claimed in claim 7, wherein the holder includes a weather-side extension which carries an elastic edge protection for the outer pane.

10. A facade structure as claimed in claim 9, wherein the bearing element comprises a window sash, and wherein the elastic edge protection at the same time forms a stop seal relative to a blind frame.

11. A facade structure as claimed in claim 9, wherein the bearing member comprises a post or transom the elastic edge protection comprising a sealing means which closes a space between said outer pane and an adjacent outer pane and which is flush with the surface of the outer and adjacent outer panes.

12. A facade structure as claimed in claim 4, wherein the spring strip is snapped into a slot in said bearing member, said structure further comprising at least one strip-shaped supporting member inserted into said slot for supporting said plate element.

13. A facade structure as claimed in claim 7, wherein the spring strip is snapped into a slot in said bearing member, said structure further comprising at least one strip-shaped supporting member inserted into said slot for supporting said plate element.

14. A facade structure as claimed in claim 1, wherein the resilient pivoting and pressing means comprises a spring strip having an approximately V-shaped cross-section and being fitted into a slot, one leg of said spring strip being supported by means of the bearing member and its other leg pressing against the holder on its side located opposite the plate edge.

* * * * *